US005984755A

United States Patent [19]

Avey

[11] Patent Number: 5,984,755

[45] Date of Patent: Nov. 16, 1999

[54] COMBINATION PLAY STATION AND CONTAINER

[76] Inventor: Jennie L. Avey, Rt.#3 Box 284, Hedgesville, W. Va. 25427

[21] Appl. No.: 09/036,956

[22] Filed: Mar. 9, 1998

[51] Int. Cl.[6] ..... A63H 33/04; B65D 5/50; B65D 5/46; B65D 5/00

[52] U.S. Cl. ..... 446/75; 446/80; 206/765; 229/117.24; 229/120.01; 229/122

[58] Field of Search ..... 446/71, 72, 75, 446/76, 79, 80, 478, 487; 206/748, 747, 765; 229/117.24, 120.01, 122

[56] References Cited

U.S. PATENT DOCUMENTS

| | | | |
|---|---|---|---|
| 1,510,763 | 10/1924 | Canal | 206/748 X |
| 2,804,226 | 8/1957 | Freedman | 206/749 X |
| 3,182,420 | 5/1965 | Bender | 446/478 |
| 3,363,360 | 1/1968 | Ryan | 446/478 |
| 4,480,744 | 11/1984 | Blackmon | 206/747 X |
| 4,637,544 | 1/1987 | Quercetti | 229/117.24 |
| 4,696,652 | 9/1987 | Reeder et al. | 446/478 X |

FOREIGN PATENT DOCUMENTS

| | | | |
|---|---|---|---|
| 2178331 | 2/1987 | United Kingdom | 446/478 |

*Primary Examiner*—D Neal Muir

[57] ABSTRACT

The present invention relates to a combination play station and container. In its broadest context, the invention includes a receptacle with a number of flaps secured thereto. Additionally, the receptacle includes a number of smaller containers which are slidably secured thereto. These smaller containers are labeled with the names of various vehicle accessories. Additionally, these containers are adapted to hold toy versions of such accessories. In the preferred embodiment, there are three flaps which are each pivotally secured to the container. These flaps can be pivoted outwardly such that entire container obtained an opened configuration. Alternatively, each of the flaps can be folded over the receptacle such that the container in placed in a closed orientation.

3 Claims, 2 Drawing Sheets

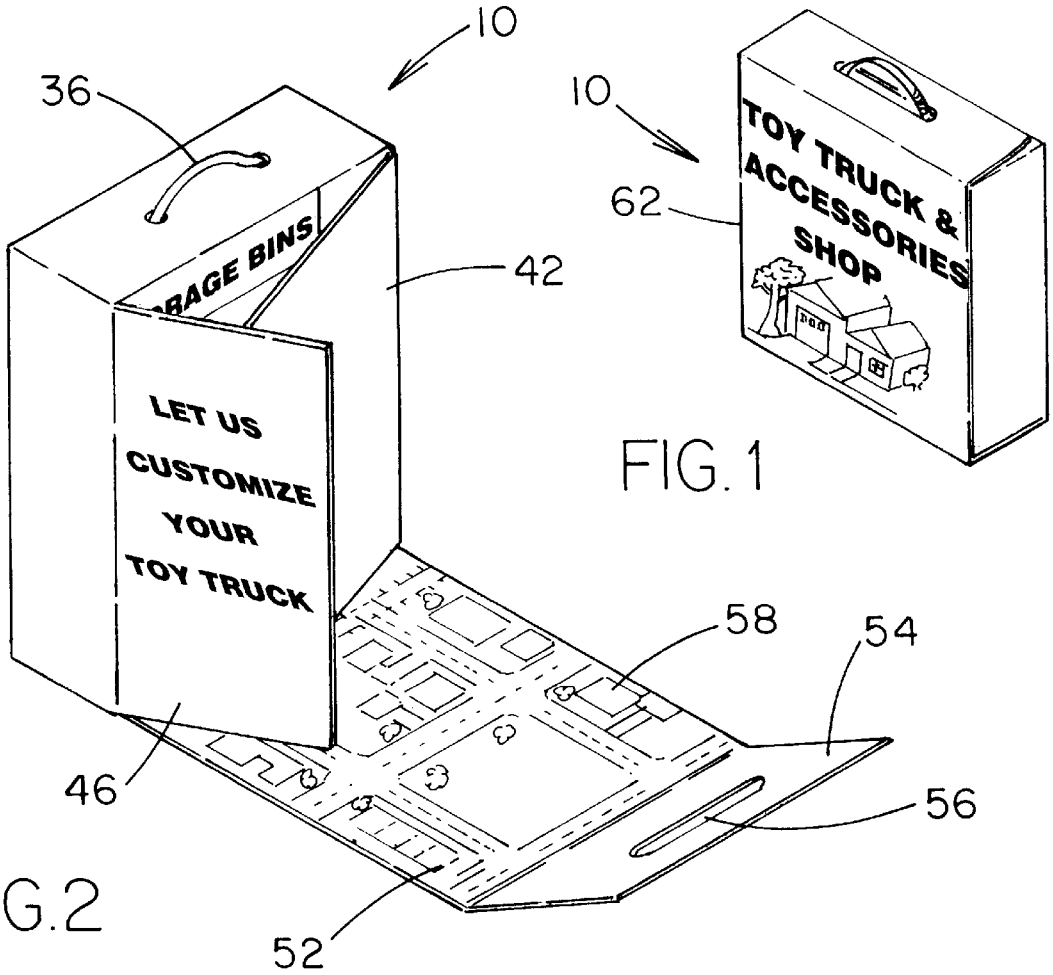
FIG.2
FIG.1
FIG.4
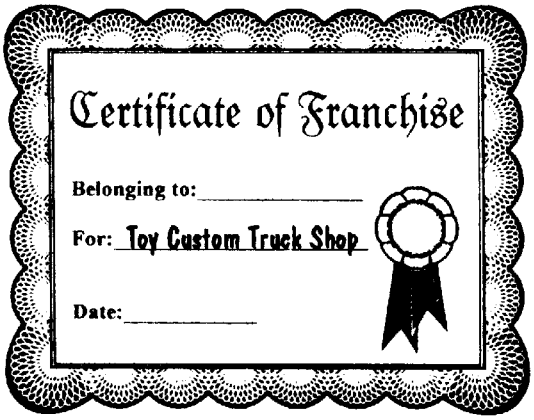
FIG. 3
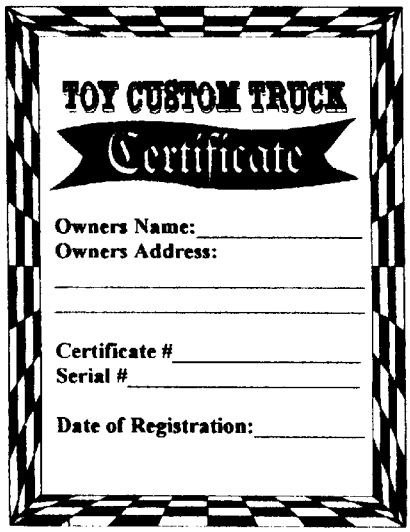

COMBINATION PLAY STATION AND CONTAINER

BACKGROUND OF THE INVENTION

1. Field of the Invention

The present invention relates to a container and more particularly pertains to such container which functions as a play station for toy vehicles.

2. Description of the Prior Art

The use of a toy vehicles is known in the prior art. More specifically, such toy vehicles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,631,040 to Shiraishi discloses a construction toy set. U.S. Pat. No. 3,962,820 to Good discloses a connection for miniature toy vehicle parts. U.S. Pat. No. 3,996,692 to Daenen discloses a car and boat toy with removable parts. U.S. Pat. No. 4,895,542 to de Blanitza discloses a toy automobile with attachments. U.S. Pat. No. 3,953,937 to Pfeilsticker discloses a part assembly for toy vehicles. U.S. Design Pat. No. 313,824 to Weiland discloses a toy dump truck attachment.

In this respect, the container and play station of the present invention substantially departs from the conventional concepts and designs of the prior art, and in so doing provides an apparatus primarily developed for the purpose of providing a play area for toy vehicle and a storage compartment for toy vehicle components.

Therefore, it can be appreciated that there exists a continuing need for improved toy play stations. In this regard, the present invention substantially fulfills this need.

SUMMARY OF THE INVENTION

In view of the foregoing disadvantages inherent in the known types of toy vehicles, and associated component parts, now present in the prior art, the present invention provides a novel combination play station and toy vehicle storage container. As such, the general purpose of the present invention, which will be described subsequently in greater detail, is to provide a multi-function container.

To attain this, the present invention essentially comprises a combination play station and container. In its broadest context, the invention includes a receptacle with a number of flaps secured thereto. Additionally, the receptacle includes a number of smaller containers which are slidably secured thereto. These smaller containers are labeled with the names of various vehicle accessories. Additionally, these containers are adapted to hold toy versions of such accessories. In the preferred embodiment, there are three flaps which are each pivotally secured to the container. These flaps can be pivoted outwardly such that entire container obtained an opened configuration. Alternatively, each of the flaps can be folded over the receptacle such that the container in placed in a closed orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination play station for toy vehicles and container. The combination comprises a major receptacle having an interior, a forward opened portion, and a closed rearward portion. The forward opened portion is defined by first and second elongated edges as well as by upper and lower edges. The major receptacle further includes and upper surface with a handle secured thereto. Nine smaller containers are included, with each of the smaller containers being slidably secured within the major receptacle and disposed in a first, a second, and a third horizontal row with three containers per row. Each of the containers has item labels, the containers within the first row being labeled "Hitches", "Running Boards", and "Sun Roofs", the containers within the second row being labeled "Visors", "Bed Liners" and "Bug Shields", the containers within the third row being labeled "Grill Guards", "vent Visors" and "Tonneau Covers". A first side flap is secured along the first edge of the major receptacle, with the first side flap having a first orientation wherein the flap is disposed over the major receptacle and a second orientation wherein the flap is folded away from the major receptacle. The first side flap has an inner surface, the inner surface contains pictures corresponding to the items labeled upon the smaller containers. A second side flap is included and is secured to the second edge of the major receptacle, the second side flap has a first orientation wherein the flap is disposed over the major receptacle and a second orientation wherein the flap is pivoted away from the major receptacle. The second flap has an inner surface,with the inner surface containing pictures of an office environment. A third flap is secured to the lower edge of the major receptacle, with the third flap having an outer extent with a pivotal upper cover secured thereto, the upper cover has a oblong cutout formed therein adapted to be inserted over the handle. The third flap has a first orientation covering the major receptacle with the upper cover disposed over the upper surface and handle of the major receptacle. The third flap has both inner and outer surfaces, with the inner surface having streets and roads depicted thereon, and the outer surface having indicia printed thereon.

It is another object of the present invention to provide a storage container for toy vehicle accessories.

It is a further object of the present invention to provide such a container which also functions as a play station for toy vehicles.

An even further object of the present invention is to provide such a container/play station which is susceptible of a low cost of manufacture with regard to both materials and labor, and which accordingly is then susceptible of low prices of sale to the consuming public, thereby making such container/play station economically available to the buying public.

Still another object of the present invention is to provide a container with pictures of the various accessories stored within the container.

Lastly, it is an object of the present invention to provide a container/play station with two orientations: a first opened orientation and a second closed orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a view of the container in its closed orientation.

FIG. 2 is a view of the container in a partially opened orientation.

FIGS. 3 and 4 illustrate official certificates which are included within the container.

Similar reference characters refer to similar parts throughout the several views of the drawings.

Description of the Preferred Embodiment

Figure 5:
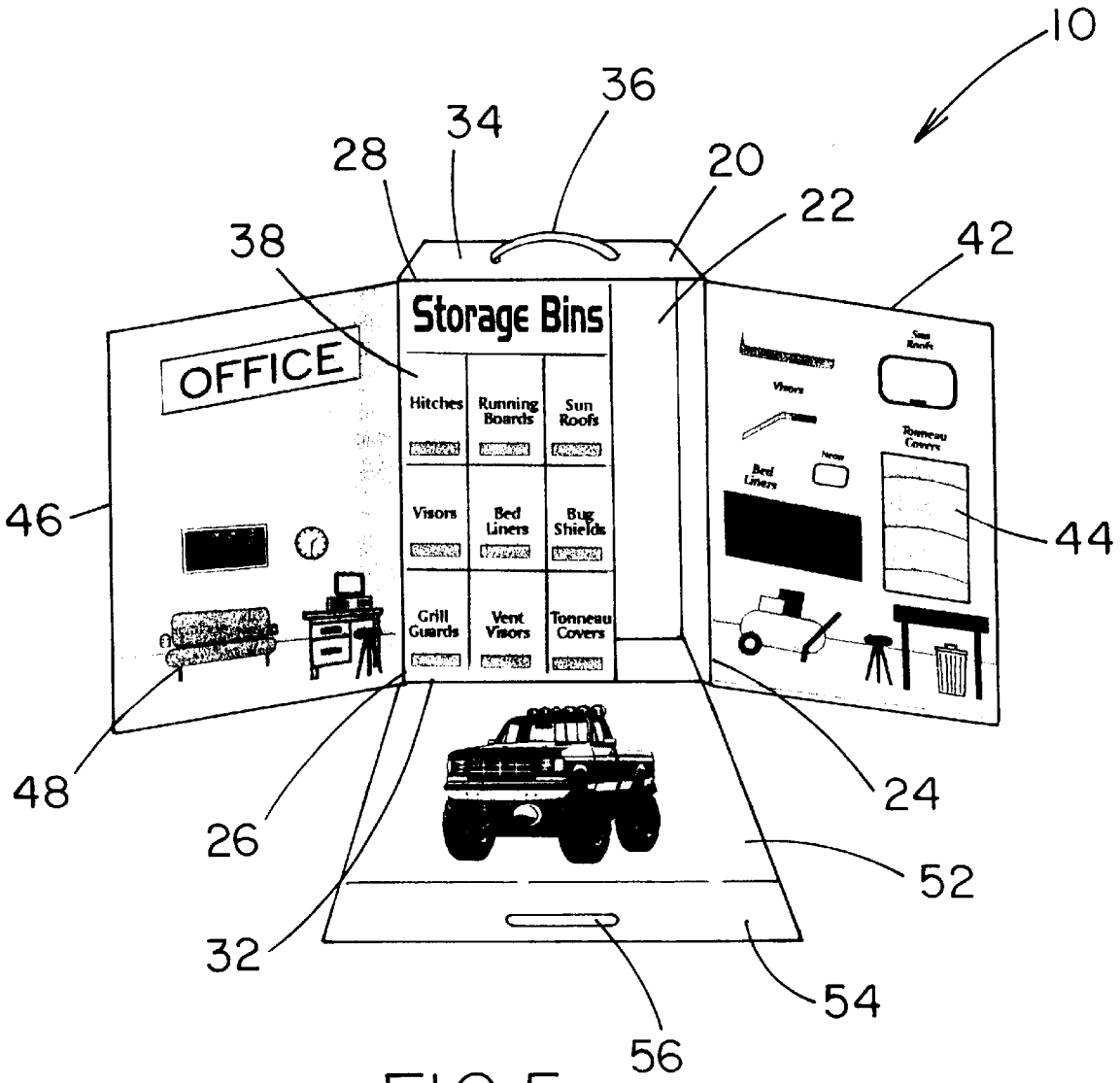
FIG. 5 is a view of the container in its opened orientation.

With reference now to the drawings, and in particular to FIG. 1 thereof, the combination play station and container is depicted. In its broadest context, the invention includes a receptacle with an number of flaps secured thereto. Additionally, the receptacle includes a number of smaller containers which are slidably secured thereto. These smaller containers are labeled with the names of various vehicle accessories. Additionally, these containers are adapted to hold toy versions of such accessories. In the preferred embodiment, there are three flaps which are each pivotally secured to the container. These flaps can be pivoted outwardly such that entire container obtained an opened configuration. Alternatively, each of the flaps can be folded over the receptacle such that the container in placed in a closed orientation. The various components of the preset invention, and the manner in which they interrelate will be described in greater detail hereinafter.

With reference to FIG. 5, the combination play station and container 10 is illustrated in its opened configuration. Such container is specifically for use in conjunction with toy vehicles. The container of the present invention includes a major receptacle 20. This major receptacle 20 is defined by an interior 22, a forward opened portion, and a closed rearward portion. The forward opened portion, in turn, is defined by first 24 and second 26 elongated edges as well as upper 28 and lower 32 edges. With continuing reference to FIG. 5, the upper surface 34 of the major receptacle, and the handle 36 which is secured thereto, is illustrated.

In the preferred embodiment, nine smaller containers 38 are included within the major receptacle. Each of these smaller containers 38 is slidably secured within the major receptacle 20. The preferred arrangement has the smaller containers 38 disposed in first, second, and third horizontal rows, with three containers per row. Additionally, each of the containers has an item labels. The preferred labeling arrangement is as follows: the containers within the first row are labeled "Hitches", "Running Boards", and "Sun Roofs"; the containers within the second row are labeled "Visors", "Bed Liners" and "Bug Shields";and the containers within the third row are labeled "Grill Guards", "Vent Visors" and "Tonneau Covers". Such labels corresponding to the miniature vehicle items which can be stored within each of the smaller containers 38.

The flaps associated with the major receptacle will next be described. The first side flap 42 is secured along the first edge 24 of the major receptacle 20. This first side flap 42 has a first orientation wherein the flap 42 is disposed over the major receptacle 20, and a second orientation wherein the flap 42 is folded away from the major receptacle 20. FIG. 5 illustrates the first flap 42 in the second orientation. Additionally, the first side flap includes an inner surface. Such inner surface, in the preferred embodiment,contains pictures 44 corresponding to the items labeled upon the smaller containers. Thus, the inner surface contains pictures of visors, bed liners, sun roofs etc. Thus, with the container in its opened orientation, a user can readily see exactly what items are stored within each of the nine smaller containers.

The second side flap 46, in a similar fashion, is secured to the second edge 26 of the major receptacle. The second side flap 46 has a first orientation wherein the flap 46 is disposed over the major receptacle 20, and a second orientation wherein the flap 46 is pivoted away from the major receptacle 20. This second orientation is illustrated in FIG. 5. The second flap 46 also includes an inner surface. In the preferred embodiment, such inner surface contains pictures 48 of an office environment. For example, the inner surface can depict a desk, a chair, a computer a couch and the like.

The third flap 52 is secured to the lower edge 32 of the major receptacle 20. This flap 52 further includes an outer extent with a pivotal upper cover 54 secured thereto. The upper cover has a oblong cutout 56 formed through its thickness. The cutout 56 is adapted to be inserted over the handle 36, such that the handle 36 can extend through the upper cover 54. The first orientation of the third flap 52 is achieved with the flap covering the major receptacle 20 and with the upper cover 54 disposed over the upper surface 34. In such orientation, the handle 36 of the major receptacle 20 extends through the upper cover 54. The third flap 52 includes both inner and outer surfaces each with indicia formed thereon. The inner surface having streets and roads 58 depicted thereon, and the outer surface having indicia 62 printed thereon.

Thus, with the container in the opened orientation, illustrated in FIG. 5, toy vehicles can be maneuvered over the streets depicted upon the inner surface of the third flap. Additionally, the user can select, via the items depicted upon the inner surface of the first flap, the items for accessorizing the vehicle. Such items can be found with in smaller containers with the major receptacle. The closed orientation of the container is achieved by placing both the first and second flaps in facing relation with the major receptacle. Then, the third flap can be placed in facing relation, overlying both the first and second flaps. The upper cover can then be folded overtop of the container with the aperture of the upper cover inserted over the handle of the container. In this manner, the container is maintained in its closed orientation. Lastly, the container can also include such items as official certificates denoting the vehicle accessory shop. Such certificates are illustrated in FIGS. 3 and 4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A combination play station for toy vehicles and container, the combination comprising in combination:

a major receptacle having an interior, a forward opened portion, and a closed rearward portion, the forward opened portion being defined by first and second elongated edges as well as upper and lower edges, the major receptacle further including an upper surface with a handle secured thereto;

nine smaller containers, each of the smaller containers being slidably secured within the major receptacle and disposed in a first, a second, and a third horizontal row with three containers per row, each of the containers having item labels;

a first side flap secured along the first edge of the major receptacle, the first side flap having a first orientation wherein the flap is disposed over the major receptacle and a second orientation wherein the flap is folded away from the major receptacle, the first side flap having an inner surface, the inner surface containing pictures corresponding to the items labeled upon the smaller containers, a second side flap secured to the second edge of the major receptacle, the second side flap having a first orientation wherein the flap is disposed over the major receptacle and a second orientation wherein the flap is pivoted away from the major receptacle, the second flap having an inner surface, the inner surface containing pictures of an office environment;

a third flap secured to the lower edge of the major receptacle, the third flap having an outer extent with a pivotal upper cover secured thereto, the upper cover having an oblong cutout formed therein adapted to be inserted over the handle, the third flap having a first orientation covering the major receptacle with the upper cover disposed over the upper surface and handle of the major receptacle, the third flap having inner and outer surfaces, the outer surface having indicia printed thereon the play station having a closed orientation formed when the first, second and third flaps are in the first orientation, this orientation allowing the entire play station to be transported by the handle, the play station also having an opened orientation wherein the first and second flaps are pivoted away form the major receptacle and the third flap is pivoted downwardly, the first, second and third flaps in the second orientation engaging a horizontal surface to thereby support the entire play station.

2. The combination play station and container as described in claim 1 wherein:

the containers within the first row are labeled "Hitches", "Running Boards", and "Sun Roofs", the containers within the second row are labeled "Visors", "Bed Liners" and "Bug Shields", the containers within the third row are labeled "Grill Guards", "vent Visors" and "Tonneau Covers."

3. The combination play station and container as described in claim 2 wherein:

the inner surface of the third flap has streets and roads depicted thereon.

* * * * *